United States Patent [19]

Ressi di Cervia

[11] Patent Number: 4,582,453

[45] Date of Patent: Apr. 15, 1986

[54] METHOD AND APPARATUS FOR IN SITU FORMING UNDERGROUND PANELIZED CONCRETE WALLS WITH IMPROVED JOINT STRUCTURE

[75] Inventor: Arturo L. Ressi di Cervia, New York, N.Y.

[73] Assignee: Finic, B.V., Rotterdam, Netherlands

[21] Appl. No.: 641,157

[22] Filed: Aug. 16, 1984

[51] Int. Cl.[4] ..... E02D 5/20; E02D 27/00

[52] U.S. Cl. ..... 405/267; 52/396

[58] Field of Search ..... 52/396, 573, 127.3; 405/267; 264/34, 35

[56] References Cited

U.S. PATENT DOCUMENTS

| | | | |
|---|---|---|---|
| 2,791,886 | 5/1957 | Veder | 405/267 |
| 3,310,952 | 3/1967 | Veder | 405/267 |
| 3,587,198 | 6/1971 | Hensel | 264/35 X |
| 3,796,054 | 3/1974 | Piccagli | 405/267 |
| 4,059,935 | 11/1977 | Faid | 52/573 X |
| 4,148,167 | 4/1979 | Puccio | 52/396 |
| 4,453,862 | 6/1984 | Stenne | 405/267 |

FOREIGN PATENT DOCUMENTS

| | | | |
|---|---|---|---|
| 0006018 | 12/1980 | Japan | 405/267 |

*Primary Examiner*—John M. Jillions
*Attorney, Agent, or Firm*—Jim Zegeer

[57] ABSTRACT

This invention relates to slurry method and apparatus for forming panelized concrete walls with a positive seal between joints. The invention is basically an improvement on the process disclosed in Veder U.S. Pat. No. 3,310,952. The slurry method or process includes the formation of a plurality of overlapping trench sections in the presence of a slurry, typically a thixotropic bentonite, with the overlapping ends between trench sections being maintained open by a hollow tubular pipe member. The joint between the concrete panels include a positive seal member bridging the gap between the adjoining panels. Portions of the positive seal members according to this invention are carried furled or folded in slots in the end stop pipe. Each furled seal portion is comprised of a vertical support bar having sealingly secured thereto a plurality of horizontally extending anchor and seal portions rigidly secured to one surface of the vertical support bar where the concrete is to be poured in a panel section. The furled positive seal member is sealingly coupled to the opposite side of the vertical support bar member and is unrolled or unfurled after the stop pipe has been removed and the next succeeding panel excavation has been performed. In this way, the positive seal remains in a protected position during the excavation for the next panel section and is then unfurled from the protected position into the slurry in the just excavated panel section.

6 Claims, 13 Drawing Figures

PRIOR ART (U.S. PATENT 3,796,054)

T2 (TO BE EXCAVATED)

METHOD AND APPARATUS FOR IN SITU FORMING UNDERGROUND PANELIZED CONCRETE WALLS WITH IMPROVED JOINT STRUCTURE

BACKGROUND AND BRIEF DESCRIPTION OF THE INVENTION

The construction of reinforced concrete walls using the slurry trench technique is basically disclosed in Veder U.S. Pat. Nos. 2,791,886 and 3,310,952 and is now well known in the art and basically comprises a formation of slots or trench sections in the earth in panel form in the presence of a slurry, typically a bentonite slurry, which slurry is displaced by the concrete to form concrete walls. In the case of steel reinforced walls, a slot is excavated in the earth in the presence of the bentonite slurry and a stop end pipe is inserted in one end of the slot and steel reinforcing cage is then lowered into the slot. Concrete is then inserted into the slot or trench to displace the bentonite slurry, such concreting typically being done by the tremie pipe technique. After the concrete has hardened, or solidified to where it is at least self-sustaining, the stop end pipe is removed to form the beginning space for the next succeeding panel section. There have been many efforts in the past to create a positive seal in the joints of such slurry walls but a simple solution to the problem has eluded the art for many years. For example, in Piccagli U.S. Pat. No. 3,796,054, flexible membranes are carried in the stop end pipes which remain in place when the stop end pipe has been removed so as to provide a barrier to the flow of fluids at the joint. However, when located between the side walls of the excavation, Piccagli's joint seals protrude into the next panel section where they interfer with the excavation after the removal of the end stop pipes carrying such seals. Moreover, the seals were limited in extent, being a compromise between the length desired and the need to avoid their protrusion and interference in the excavation of the adjacent panel section.

The present invention provides a simple solution to a problem that has eluded the art for many years. According to this invention, a joint membrane is stowed in a furled or plicated condition during excavation of the adjacent panel section so as to not impede or interfere with the excavation process and, at the same time, be retained in a protected condition so that the excavating implements do not puncture, tear, wrinkle or otherwise damage the integrity of the seal membrane. After the excavation is completed, the stowed portion of the membrane is unfurled or unfolded into the next excavating section just prior to the introduction of the concrete.

If the wall is to have reinforcing steel or armor therein, the joint may have the reinforcement continuous in the manner disclosed in my application Ser. No. 598,632 filed Apr. 10, 1984.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1A:
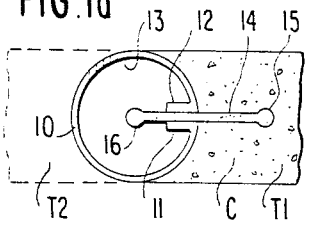
FIGS. 1*a*–1*e* are examples of prior art joint membranes as disclosed in U.S. Pat. No. 3,796,054.
Figure 1B:
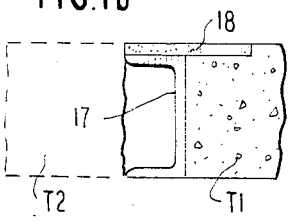
Figure 1C:
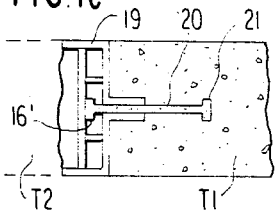
Figure 1D:
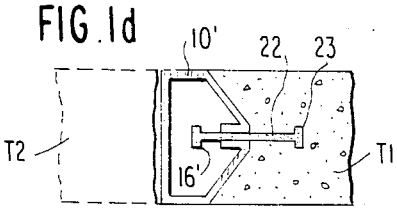
Figure 1E:
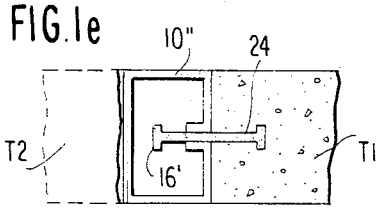
Figure 2A:
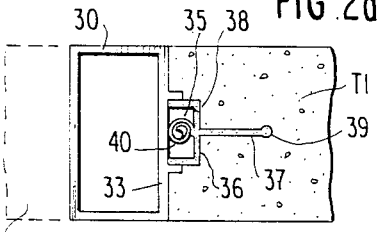
FIGS. 2*a*, 2*b* and 2*c* illustrate a first embodiment of the invention.
Figure 2B:
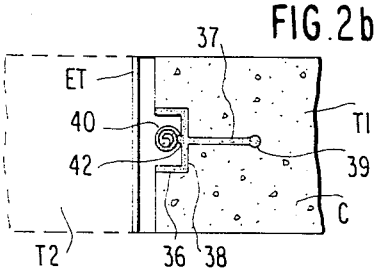
Figure 2C:
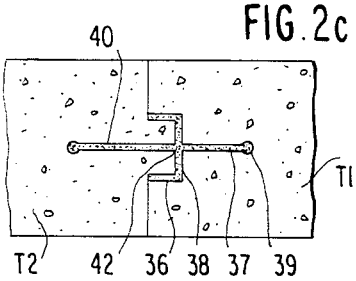

The basic slurry trench technology is disclosed in the aforementioned Veder patent and with reference particularly to FIG. 1*a* (from U.S. Pat. No. 3,796,054), a hollow tubular end stop pipe 10, which may be rectangular as shown in FIG. 1*e* or the sloped side configuration shown in FIG. 1*d* is placed at one end of a slurry filled trench or slot excavation such as T1 and concrete C is introduced, typically by the tremie pipe method, so as to displace the bentonite and cast the concrete against the end stop pipe 10. When the end stop pipe 10 is removed, the next succeeding and adjacent excavation in trench section T2 can be performed using a portion of the space 13 occupied by end stop pipe 10 as a starting hole to assure alignment with the preceding concrete panel section in trench T1. It sometime happens that the joint between the concrete end panel section T1 and end panel section T2 is less than perfect and can leak, particularly when a head of water is applied to the joint. In order to achieve water tightness in the joint, a membrane 14 is incorporated in the joint, such membranes being held in position by a pair of lips 11 and 12 formed in end pipe 10 and the membrane having a pair of end enlargements 15 and 16, respectively. According to U.S. Pat. No. 3,796,054, end stop pipe 10 is slowly removed while the membrane 14 is retained in place by the concrete and the lips 11 and 12 slide freely vertical relatively thereto and supports the membrane where it is engaged. The steel frame is removed gradually as the concrete starts to harden at the lower end and at essentially the same vertical rate as the concrete hardened from the bottom upwardly so that the bottom of the steel frame gradually moves above the concrete hard enough to be self-supporting but not sufficiently hard to bond to the steel frame. The same process is followed essentially in the structure shown in FIG. 1*b* wherein the membrane 18 is maintained flush against the trench wall by end stop channel member 17. In FIG. 1*c*, a fabricated steel frame structure 19 supports the membrane 20 having an enlarged end 21 during the setting of the concrete in the withdrawal thereof from the excavation. In FIG. 1*d*, the steel channel member 10' holds the membrane 22 in position during the time the end 23 is immersed in the concrete in trench T1 and the concrete is setting. Similarly in connection with the rectangular end stop pipe 10'' shown in FIG. 1*e*, the membrane 24 is similar to the membrane shown in FIGS. 1*c* and 1*d*. In all these instances, after the end stop pipe or steel frame work for holding the membrane is withdrawn from the excavation to provide the space 13 for the next succeeding and adjacent excavation, a large portion, substantially one half, of the membrane projects into the space 13 previously occupied by the membrane. In the case of the structure shown in FIG. 1*c*, not very much of the membrane projects into the next succeeding panel section T2. When the excavation proceeds in connection with the adjacent wall section, the excavating tool, typically a clam-shell excavator back hoe etc. can impinge upon the projecting ends of the membranes and damage same. Moreover, the operator must use great care to avoid having the excavating tool contact the projecting membrane end 16.

THE PRESENT INVENTION

Figure 3:
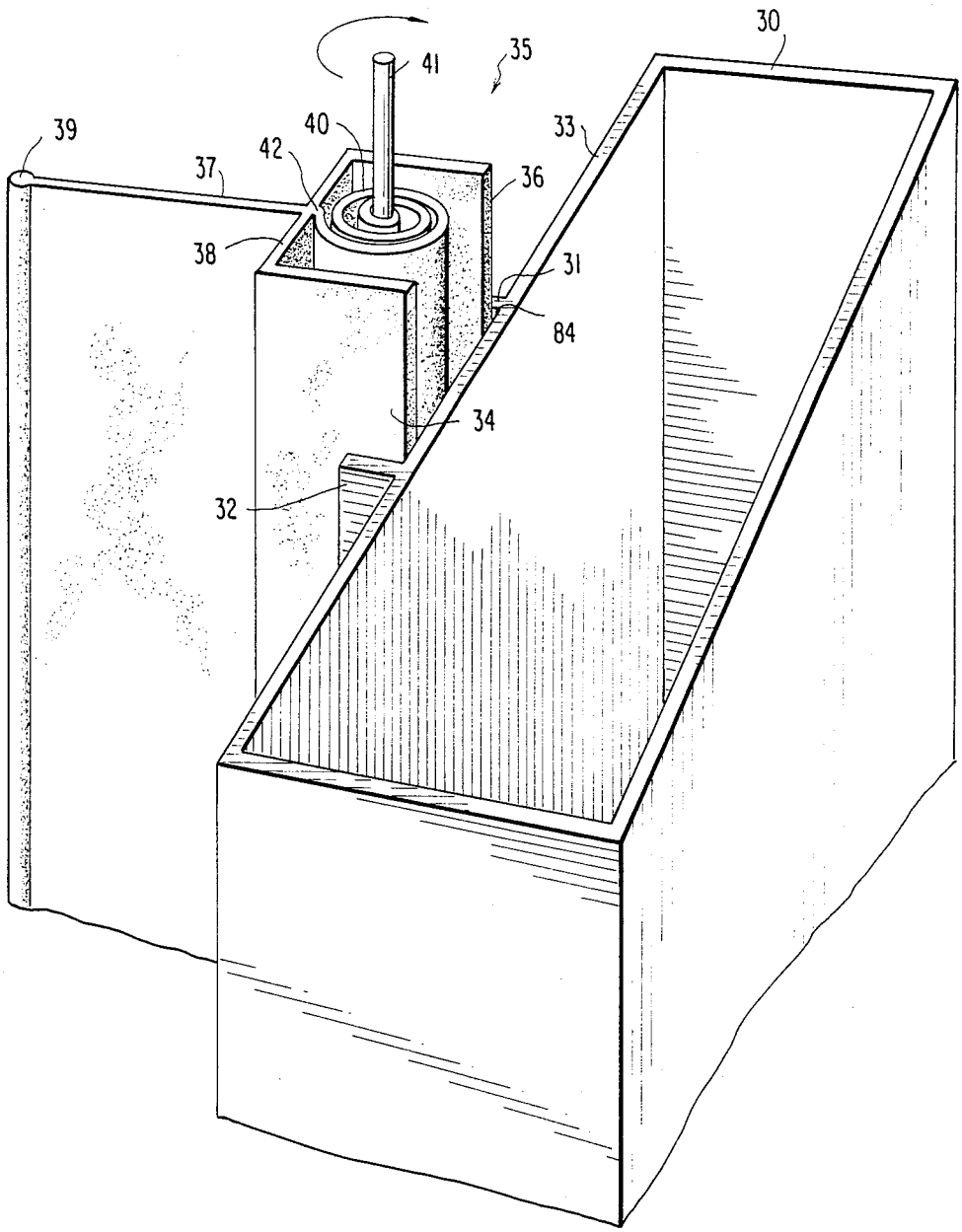
FIG. 3 is an enlarged perspective view of a joint seal incorporating the invention.

The present invention solves the problem by stowing the membrane in a furled or folded condition during the excavation of the adjacent slot or trench section and then unfurling or unfolding the membrane after the excavation has been completed in the adjoining section. In addition, in the case of steel reinforced concrete walls constructed in situ underground, the present invention provides, as a further feature or embodiment, a stowed joint reinforcing steel cage which is likewise stowed in a retracted or protected position during the excavation of the adjoining section which is then unstowed or unfolded into the adjoining section prior to the pouring of concrete. Referring to FIGS. 3 and 4, in a first embodiment of the invention, a rectangular end stop pipe 30 is provided with a pair of ribs 31 and 32 projecting from side 33 to form a channel 84 in which is stowed the membrane structure 35.

The membrane structure 35 includes a channel member 36, typically an extruded polyvinylchloride structure, which has a membrane portion 37 projecting normally to the backside base 38 of channel 36. An enlargement 39 is formed on the end of membrane 37 so as to assure better locking-in when the concrete is cast thereabout. Between the legs 34 and 36 is a furled membrane portion 40 which is furled about a rod 41. One end 42 of membrane portion 40 is sealingly secured (by sonic, RF or other welding or by an adhesive, etc.) to the inner portion of base 38 of channel member 36. In order to prevent concrete from sticking to the molding surfaces of channel member 30, the molding surfaces per se can be coated with a release material such as Teflon or the like.

Figure 4A:
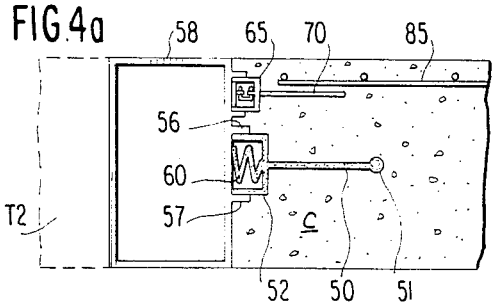
FIGS. 4*a*, 4*b* and 4*c* illustrate the installation of an underground wall incorporating the seal joint structure and continuous joint reinforcing structure.
Figure 4B:
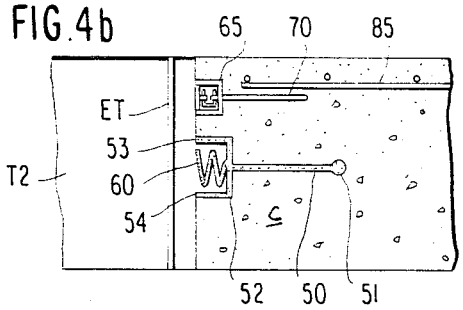
Figure 4C:
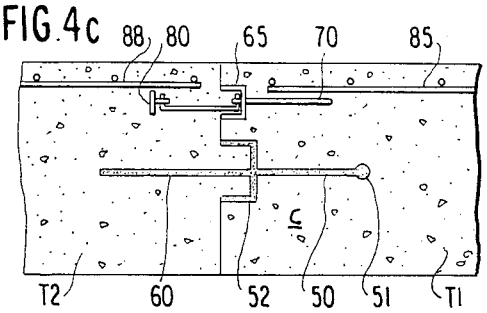

Referring to FIGS. 4*a*, 4*b* and 4*c*, the end stop pipe 30 is shown in place with the concrete cast C in trench or slot section T1 in and about the seal membrane 37. In FIG. 4*b*, the end stop pipe 30 has been withdrawn from the trench and the teeth of a clam shell excavator, back hoe, etc. is illustrated as performing an excavation of the trench section T2 utilizing as a guide the space formerly occupied by the end stop pipe 30. Since the seal member 40 is in a furled or rolled-up condition, and protected in its stowed condition in the legs of channel 35, the teeth of the clam shell excavator cannot damage in any way the joint seal membrane 40 and the operator can proceed to make the excavation without injury to the seal and in the larger space 13 provided thereby. As shown in FIG. 4*c*, the excavation of the trench section T2 has been completed, the seal 40 unfurled and concrete has been placed inside the trench.

Figure 5:
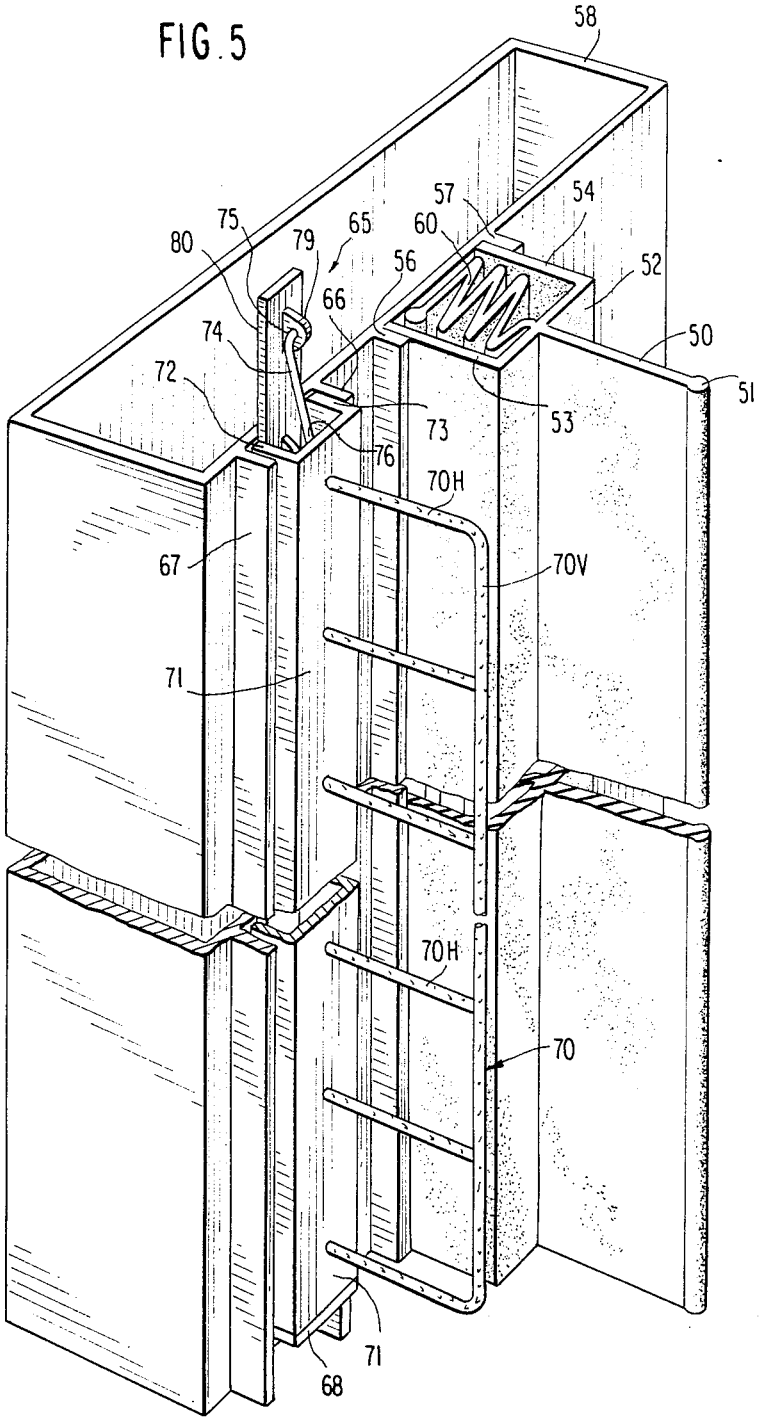
FIG. 5 illustrates the modification of the invention incorporating, in part, the continuous joint reinforcing structure as disclosed in my application Ser. No. 598,632, as shown in FIGS. 4*a*, 4*b* and 4*c*

Referring to the embodiment shown in FIGS. 5, 4*a*, 4*b* and 4*c*, in this case the joint seal membrane is constituted of a rigid portion 50 having an enlarged end 51 for anchoring in the concrete and is made of polyvinylchloride and is joined to or made integral with a polyvinylchloride channel member 52 which has legs 53 and 54 snuggly fitting between ribs 56, 57 on rectangular end stop 58. In this case, the flexible membrane seal portion 60 is folded or plicated in its stowed condition within legs 53 and 54 of channel member 52. In this embodiment, the wall being formed has steel reinforcing bars or cages 85 therein and in order to assure that the steel reinforcing bars are continuous through the joint, a joint reinforcing assembly 65 which is disclosed in my above-referenced pending patent application and is carried between a pair of rib members 66 and 67 on rectangular end stop pipe 58. A bottom plate 68 prevents the intrusion of concrete into the channel space when the concrete is poured in trench section T1 as is indicated in FIG. 5. The joint reinforcing steel assembly 65 includes an anchor assembly 70 which is shown as a vertical reinforcing bar 70V and a plurality of horizontal reinforcing bars 70H, each secured to the back of a steel channel member 71, the legs 72 and 73 of channel member 71 fitting snuggly between ribs 66 and 67. An expandible reinforcing cage is constituted by a plurality of bar link members 74 pivoted at their ends 75 and 76 to the pivot members 79 on operating bar 80 and a similar pivot (not shown) on the inside base of the channel members 71. As shown in FIGS. 4*a*, 4*b* and 4*c*, after the first excavation in trench section T1 has been concreted, the assembly shown in FIG. 5 is inserted into the end of the trench with the seal portion 50 and reinforcing cage portion 70H and 70V projecting into the excavated portion. A reinforcing cage 85 is positioned in the excavated trench section and then concrete is inserted into the trench to displace the bentonite slurry therein. The usual and conventional techniques of vibrators and the like to assure the elimination of air bubbles and the proper consistency of the concrete are utilized at this time. After the concrete has begun to harden, and is substantially self-sustaining, the steel end stop pipe 58 is withdrawn leaving the seal stop assembly 50, 52 and 54 along with joint steel reinforcing cage assemblies 65 with the membrane portion 50 and reinforcing cage portions 70 embedded in the concrete as shown in FIG. 4*a*. As shown in FIG. 4*b*, the teeth of an excavating tool ET can utilize the open space left by the removal of the end stop pipe 58 to perform the next succeeding excavation in trench slot section T2. It will be appreciated that while the excavation is proceeding, the excavation in trench section T2 is maintained full of an excavating slurry, typically a bentonite excavating slurry which maintains the wall of the excavation in a stabilized condition and avoids cave-ins, sluffing etc. After the excavation is completed, a further reinforcing cage 88 is inserted into trench section T2 and the folded steel reinforcing cage portion 75 of steel cage reinforcing cage 65 is expanded into the position shown in FIG. 4*c*. The folded portion of the seal membrane 54 is likewise unfolded from its folded or furled condition to the condition shown in FIG. 5. Thereafter, concrete is tremie into trench section T2. It will be appreciated that at the opposite open end of trench section T2, a similar end stop pipe procedure is performed for the next succeeding trench section.

It will be appreciated that the basic objectives of the invention have been met since the excavation of joining trench sections can be more expeditiously and efficiently carried out with a portion of the seal membrane in a stowed and protected position during the performance of the excavation and, after the completion of the excavation is unfurled and unstowed into a position where it can perform its normal function.

While I have disclosed several embodiments of the invention, it will be appreciated that these are exemplary and that those skilled in the art can modify and adapt the invention in ways obvious to those skilled in the art without departing from the spirit and scope of the invention as defined in the claims appended hereto.

What is claimed is:

1. In a method of constructing an underground concrete wall in a plurality of vertical concrete panel sections, each section being excavated in the presence of an excavating slurry for stabilizing the excavation walls, an end stop pipe being located at the end of a panel section excavation to define an overlapping area for a next adjacent consecutive slot with a vertical flexible membrane carried by said end stop pipe, the improvement comprising, maintaining a portion of said flexible membrane in a stowed position during excavation of the adjacent section using the space occupied by said end stop pipe after removal thereof as the overlapping portion so that the excavating tool does not damage the stowed membrane portion of said flexible membrane and is free to perform the excavation without interference with said stowed membrane portion, and unstowing said stowed membrane portion prior to casting the concrete in said next adjacent panel section.

2. The invention defined in claim 1 wherein said stowed membrane portion is furled and said unstowing of said stowed membrane portion includes the deploying and unfurling of said stowed portion.

3. The invention defined in claim 1 including maintaining an expandable steel reinforcing joint cage in a stowed and unexpanded condition such that the said excavation of the said adjacent section using the space occupied by said end stop pipe as the overlapping portion so as to not interfere with, or impede excavation of said adjacent section and be protected from excavating tools in said adjacent section, and unstowing and expanding said expandable steel reinforcing cage after completion of the excavation of said adjacent section and prior to casting concrete in said adjacent section, so that said expandable steel joint reinforcing cage spans the joint between sections.

4. The invention defined in claim 3 including the step of inserting a steel reinforcing cage in each said panel section before casting concrete therein, said expandable steel reinforcing cage spanning the space between, and overlapping the ends of the said steel reinforcing cages to adjacent panel sections, respectively, after unstowing and expansion thereof.

5. In a hollow stop end pipe for use in the slurry trench construction of a reinforced concrete wall, means forming a seal carrier in one wall of said stop end pipe, said one wall facing in the direction of concrete to be poured, the improvement comprising a plastic joint seal membrane in said carrier, said joint seal member comprising a concrete anchor and seal member extending in the direction of concrete to be poured, a channel member joined to said concrete anchor member, and a furled seal member furled and stowed in said channel member.

6. The hollow stop end pipe defined in claim 5 including means forming an expandable joint steel reinforcing cage carrier in said one wall and spaced from the said seal carrier and an expandable joint steel reinforcing cage carried in an unexpanded condition in said expandable joint steel reinforcing cage carrier, said expandable joint steel reinforcing cage having a further concrete anchor extending in the direction of the concrete to be poured.

* * * * *